US010408178B2

(12) United States Patent
Spurling et al.

(10) Patent No.: US 10,408,178 B2
(45) Date of Patent: Sep. 10, 2019

(54) FUEL RAIL FOR INTERNAL COMBUSTION ENGINE

(71) Applicant: FORD GLOBAL TECHNOLOGIES, LLC, Dearborn, MI (US)

(72) Inventors: Michael Spurling, Romford (GB); David Luz, Bahia (BR); Romulo Prado Barbieri, Bahia (BR); Felipe Sahade, Bahia (BR); Thomaz Ernesto Savio, Bahia (BR)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 146 days.

(21) Appl. No.: 15/808,121

(22) Filed: Nov. 9, 2017

(65) Prior Publication Data

US 2018/0128224 A1 May 10, 2018

(30) Foreign Application Priority Data

Nov. 9, 2016 (GB) ..... 1618923.5

(51) Int. Cl.
*F02M 55/02* (2006.01)

(52) U.S. Cl.
CPC ..... *F02M 55/025* (2013.01); *F02M 2200/185* (2013.01)

(58) Field of Classification Search
CPC ..... F02M 55/025; F02M 2200/185
See application file for complete search history.

(56) References Cited

U.S. PATENT DOCUMENTS

| | | | | |
|---|---|---|---|---|
| 5,189,782 | A | 3/1993 | Hickey | |
| 2003/0084878 | A1* | 5/2003 | Treusch | F02M 55/04 123/456 |
| 2004/0149267 | A1 | 8/2004 | Takahashi et al. | |

FOREIGN PATENT DOCUMENTS

| | | | | |
|---|---|---|---|---|
| EP | 1632675 | A1 * | 3/2006 | F02M 35/10072 |
| EP | 1632675 | A1 | 3/2006 | |
| GB | 2399392 | A | 9/2004 | |
| JP | 2007239710 | A | 9/2007 | |
| WO | 91-11607 | A1 | 8/1991 | |
| WO | 2009139081 | A1 | 11/2009 | |

* cited by examiner

*Primary Examiner* — Joseph J Dallo
(74) *Attorney, Agent, or Firm* — Frank MacKenzie; Brooks Kushman P.C.

(57) ABSTRACT

The present disclosure provides a fuel rail for use with an internal combustion engine. The fuel rail includes a plurality of fingers extending away from the fuel rail. The fingers are configured to interface with adjacent engine parts under crash conditions.

18 Claims, 1 Drawing Sheet

FUEL RAIL FOR INTERNAL COMBUSTION ENGINE

CROSS-REFERENCE TO RELATED APPLICATIONS

This application claims foreign priority benefits under 35 U.S.C. § 119(a)-(d) to GB Application 1618923.5 filed Nov. 9, 2016, which is hereby incorporated by reference in its entirety.

TECHNICAL FIELD

The present disclosure relates to improvements in or relating to fuel rails for internal combustion engine injection systems.

BACKGROUND

A fuel rail, or common fuel rail, is typically coupled to a fuel pump that feeds the fuel rail with fuel at a pressure. The fuel rail feeds a plurality of injectors with fuel at the pressure. The injectors are controlled by an ECU that opens a hydraulic valve when fuel is required. The injectors inject fuel directly into respective engine cylinders or at the intake port at a desired pressure.

Vehicle fuel rails are typically manufactured from steel in order to withstand compression forces applied between the fuel rail and a vehicle's intake manifold during crash conditions. In the event of a frontal impact, the vehicle's intake manifold can deform towards the engine and into contact with the fuel rail. A strength of the fuel rail is thus required to be higher than a strength of the intake manifold such that the intake manifold will fracture, leaving the fuel rail intact, and preventing fuel leakage that could otherwise occur as a result of fracture or splitting of the fuel rail.

During crash conditions, particularly in the event of a frontal impact, a vehicle's fuel rail will rotate and bend. Each injector is coupled to the fuel rail and a seal is provided between the fuel rail and an injector by an O-ring seal. If the fuel rail bends excessively during crash conditions the O-ring seal can fail causing fuel leakage, a disruption to fuel supply and failure of safety requirements.

It is known to provide reinforcements adjacent to the bending center of the fuel rail, but this has been found to have little effect on a fuel rail's bending strength. It is also known to provide a thick steel plate between the fuel rail and the intake manifold to reduce a load transferred into the fuel rail during crash conditions. This solution adds further weight to the vehicle, is expensive to implement and certain engine configurations may prevent this solution being employed due to limited points at which the steel plate can be mounted to the engine.

It is against this background that the present disclosure has arisen.

SUMMARY

According to the present disclosure there is provided a fuel rail for use with an internal combustion engine. The fuel rail comprises a plurality of fingers extending away from the fuel rail, and wherein the fingers are configured to interface with adjacent engine parts under crash conditions.

The fuel rail may be plastic and the fingers may be integrally molded.

Plastic has a significantly lower bending strength than steel, but is a much lighter and cheaper material. The provision of integrally molded fingers extending away from the fuel rail provides an alternative load path for the fuel rail to resist loading from the intake manifold. This occurs due to the integrally molded fingers interfacing with an adjacent engine part, such as a cylinder head or a valve cover, during crash conditions. The fingers also limit rotation of the fuel rail to thus reduce bending of the fuel rail. Any load from the intake manifold therefore bypasses the injector O-ring seals. The crash load capability of such a plastic fuel rail is at least comparable to that of a typical steel fuel rail.

It is also desirable to optimize vehicle weight as reduced weight provides improved fuel efficiency. The use of a plastic fuel rail therefore contributes to improved fuel efficiency.

The fuel rail may be metal and the fingers may be welded thereto.

The plurality of fingers may each comprise a damping element mounted thereto.

Adjacent engine components either require sufficient clearance to avoid contact during normal operating conditions or provision of a damping element, i.e. a rubber boot, to provide noise and vibration absorption capabilities. In the absence of a damping element, the plurality of fingers would require a minimum of a ten millimeter gap between an end of the fingers and an adjacent engine component. Such a configuration would result in delayed contact between the fingers and the adjacent engine component thus resulting in fuel rail bending and potential failure of injector O-rings. A damping element permits the plurality of integral fingers to be in close proximity with an adjacent engine component.

The damping element may comprise a removable rubber boot arranged between each finger and the adjacent engine component.

Use of a removable rubber boot enables the damping element to be replaced independently of the fuel rail.

The fingers may be configured to be spaced apart from adjacent engine parts under non-crash conditions. The fingers may be configured to provide spacing of less than five millimeters between said fingers and adjacent engine parts under non-crash conditions.

Adjacent engine parts can cause noise and vibration under normal operating conditions if they come into contact with one another. It is therefore advantageous to space such adjacent engine parts apart from one another to limit noise and vibration and associated wear. Conversely, it is desirable to limit bending of the fuel rail, hence minimal spacing is desirable between the fingers and adjacent engine components.

The disclosure will now be further and more particularly described, by way of example only, and with reference to the accompanying drawings, in which:

DETAILED DESCRIPTION

Figure 1:
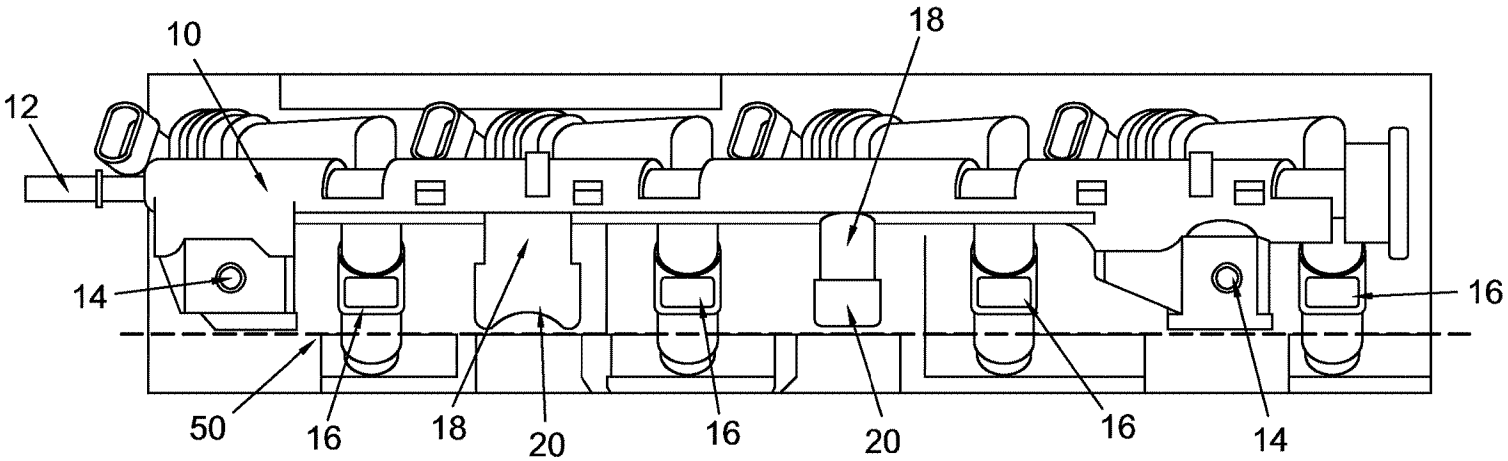
FIG. 1 illustrates a plastic fuel rail according to aspects of the disclosure.
Figure 2:
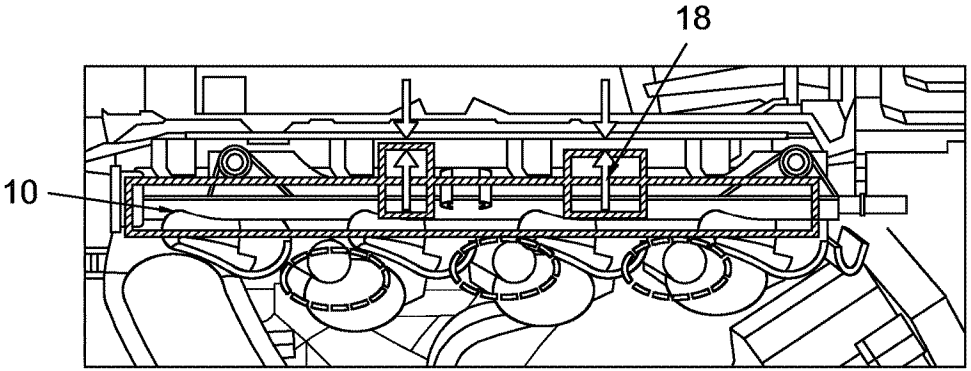
FIG. 2 illustrates the fuel rail of FIG. 1 mounted to a vehicle engine.

As required, detailed embodiments of the present disclosure are disclosed herein; however, it is to be understood that the disclosed embodiments are merely exemplary of the disclosure that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

The fuel rail 10 comprises a fuel inlet 12 coupled to a fuel pump (not shown). The fuel rail 10 is mounted to an internal combustion engine by way of two attachment legs 14. A plurality of injectors 16 are mounted to respective ports in the fuel rail 10 to provide fuel at high pressure from the fuel rail 10 to respective cylinders. Respective O-rings provide seals between each injector and the fuel rail 10. A plurality of integral fingers 18 extend from the fuel rail 10.

The fuel rail 10 is manufactured from plastic using known techniques such as injection molding or additive manufacturing. Suitable plastics include Polyamide (PA), Polyphthalamide (PPA) and Polyphenylene Sulfide (PPS). The attachment legs 14 and fingers 18 are an integral part of the fuel rail 10.

The shape, size and length of the fingers 18 can be adapted according to requirements such as distance between the fuel rail 10 and internal combustion engine, available space and distance from a bending moment center.

To prevent plastic on metal, or metal on metal, contact each finger 18 is provided with a damping element 20 in the form of a rubber boot in this embodiment, which slides on to an interfacing end 18' of each finger 18. The damping element 20 comes into contact with an adjacent engine component under crash conditions, and is spaced apart from the adjacent engine component under non-crash, or normal, operating conditions.

Under crash conditions, the fingers 18 are urged into engagement with an adjacent engine component 50, i.e. the cylinder head or valve cover, thus limiting bending of the fuel rail 10 via a small clearance between the fingers 18 and the cylinder head 50. For the fuel rail 10 to bend, the fingers 18 would have to first break before the fuel rail 10 could rotate or bend towards the cylinder head 50. The fingers 18 offer an alternative load path to reduce bending of the fuel rail 10.

It will further be appreciated by those skilled in the art that although the disclosure has been described by way of example with reference to several embodiments it is not limited to the disclosed embodiments and that alternative embodiments could be constructed without departing from the scope of the disclosure as defined in the appended claims.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. A fuel rail for an internal combustion engine, the fuel rail comprising:

a plurality of fingers extending away from the fuel rail, and are configured to interface with adjacent engine parts under crash conditions.

2. The fuel rail according to claim 1, wherein the fuel rail is a plastic fuel rail and the plurality of fingers are integrally molded.

3. The fuel rail according to claim 1, wherein the fuel rail is a metal fuel rail and the plurality of fingers are welded.

4. The fuel rail according to claim 1, wherein each of the plurality of fingers comprises a damping element mounted thereto.

5. The fuel rail according to claim 4, wherein the damping element comprises a rubber boot arranged between each respective finger and an adjacent engine component.

6. The fuel rail according to claim 1, wherein the plurality of fingers is configured to be spaced apart from adjacent engine parts under non-crash conditions.

7. The fuel rail according to claim 6, wherein the plurality of fingers is configured to provide spacing of less than five millimeters between said fingers and adjacent engine parts under non-crash conditions.

8. The fuel rail according to claim 1 wherein the adjacent engine parts include an engine cylinder head or a valve cover.

9. A vehicle comprising:

an engine having a fuel rail, cylinder head and valve cover; and a plurality of fingers extending away from the fuel rail that interfaces with the cylinder head and valve cover under crash conditions, wherein each finger comprises a damping element that is a boot arranged between each respective finger and either the cylinder head or valve cover, the damping element being mounted to each finger.

10. The vehicle as claimed in claim 9, wherein the fuel rail is a plastic fuel rail and the plurality of fingers are integrally molded.

11. The vehicle as claimed in claim 9, wherein the fuel rail is a metal fuel rail and the plurality of fingers are welded.

12. The vehicle as claimed in claim 9, wherein the plurality of fingers is configured to be spaced apart from the cylinder head and valve cover under non-crash conditions.

13. The vehicle as claimed in claim 12, wherein the plurality of fingers is configured to provide spacing of less than five millimeters between said fingers and adjacent engine parts under non-crash conditions.

14. A vehicle internal combustion engine comprising:

a cylinder head, valve cover and fuel rail; and a plurality of fingers extending away from the fuel rail, and attached thereto via two attachment legs such that the plurality of fingers is configured to interface with the cylinder head and valve cover under crash conditions, wherein each finger includes a damping element mounted thereto and arranged between each respective finger and the cylinder head or valve cover.

15. The internal combustion engine as claimed in claim 14, wherein the fuel rail is a plastic fuel rail and the plurality of fingers are integrally molded.

16. The internal combustion engine as claimed in claim 14, wherein the fuel rail is a metal fuel rail and the plurality of fingers are welded.

17. The internal combustion engine as claimed in claim 14, wherein the plurality of fingers is configured to be spaced apart from the cylinder head and valve cover under non-crash conditions.

18. The internal combustion engine as claimed in claim 17, wherein the plurality of fingers is configured to provide spacing of less than five millimeters between said fingers, and the cylinder head and valve cover under non-crash conditions.

* * * * *